US008561368B2

(12) United States Patent
Fimbel, III

(10) Patent No.: US 8,561,368 B2
(45) Date of Patent: Oct. 22, 2013

(54) CARVED SOLID FACE DOOR AND METHOD OF FABRICATION

(76) Inventor: Edward Fimbel, III, Lambertville, NJ (US)

( * ) Notice: Subject to any disclaimer, the term of this patent is extended or adjusted under 35 U.S.C. 154(b) by 934 days.

(21) Appl. No.: 11/538,870

(22) Filed: Oct. 5, 2006

(65) Prior Publication Data

US 2007/0094956 A1 May 3, 2007

Related U.S. Application Data

(60) Provisional application No. 60/723,764, filed on Oct. 5, 2005.

(51) Int. Cl.
*E04C 2/34* (2006.01)
*E04C 2/32* (2006.01)
*B44F 9/02* (2006.01)

(52) U.S. Cl.
USPC ..... 52/316; 52/314; 52/784.1; 52/783.1; 52/311.1

(58) Field of Classification Search
USPC ..... 52/311.1, 314, 316, 784.1, 783.1, 455
See application file for complete search history.

(56) References Cited

U.S. PATENT DOCUMENTS 2,703,443 A * 3/1955 Lee ..... 49/503
3,269,339 A 8/1966 Lingal
3,484,994 A * 12/1969 Ashby et al. ..... 49/501
3,498,001 A * 3/1970 MacDonald ..... 49/501
3,731,443 A * 5/1973 Zaroor ..... 52/309.7
3,732,443 A 5/1973 Zaroor
3,760,543 A 9/1973 McAllister
3,829,337 A * 8/1974 Cheng ..... 156/63
3,903,669 A 9/1975 Pease et al.
4,265,067 A * 5/1981 Palmer ..... 52/309.9
4,265,068 A 5/1981 Pomroy
4,441,296 A 4/1984 Grabendike et al.
4,579,613 A 4/1986 Belanger
4,592,402 A 6/1986 Spofford
4,643,787 A * 2/1987 Goodman ..... 156/196
4,702,054 A 10/1987 Turner
4,704,834 A 11/1987 Turner
4,706,431 A 11/1987 Corvese (Continued)

FOREIGN PATENT DOCUMENTS

EP 27569 A1 * 4/1981
JP 53090635 A * 8/1978
JP 54115528 A * 9/1979

OTHER PUBLICATIONS

"Cutting-edge technology makes woodworking profitable," Wood & Wood Products, Mar. 2009.

(Continued)

*Primary Examiner* — Phi A
(74) *Attorney, Agent, or Firm* — Alan Taboada; Moser Taboada

(57) ABSTRACT

Embodiments of a carved solid face door and methods of fabrication are disclosed herein. In one embodiment, a carved solid face door includes a solid base having a substantially flat face and an opposing rear surface, wherein the face has a design carved into at least one section of the face that emulates the appearance of a multiple-piece construction including at least one of a frame, a rail, a stile, a molding, a trim, a plurality of planks, or a panel. Optionally, a backing may be coupled to the solid base. Optionally, the solid base may comprise a plurality of horizontal sections.

21 Claims, 2 Drawing Sheets

(56) References Cited

U.S. PATENT DOCUMENTS

| | | | | | |
|---|---|---|---|---|---|
| 4,716,705 | A | | 1/1988 | Formanek et al. | |
| 4,812,188 | A | | 3/1989 | Hansen | |
| 4,853,062 | A | | 8/1989 | Gartland | |
| 4,865,894 | A | * | 9/1989 | Shubow | 428/59 |
| 4,882,877 | A | * | 11/1989 | Guetle et al. | 49/506 |
| D304,983 | S | | 12/1989 | Palka | |
| 5,022,206 | A | | 6/1991 | Schield et al. | |
| 5,062,915 | A | | 11/1991 | Yoon et al. | |
| 5,095,675 | A | | 3/1992 | Audia | |
| 5,175,970 | A | * | 1/1993 | Green | 52/309.9 |
| 5,285,608 | A | | 2/1994 | Costello | |
| 5,438,808 | A | * | 8/1995 | Costello | 52/316 |
| 5,469,903 | A | | 11/1995 | Stanley | |
| 5,487,245 | A | | 1/1996 | Dazo et al. | |
| 5,540,026 | A | | 7/1996 | Gartland | |
| 5,560,168 | A | | 10/1996 | Gagne et al. | |
| 5,568,713 | A | * | 10/1996 | Gagne et al. | 52/785.1 |
| D380,279 | S | * | 6/1997 | Lint et al. | D25/103 |
| 5,766,774 | A | | 6/1998 | Lynch et al. | |
| 5,775,041 | A | | 7/1998 | Tull et al. | |
| 5,782,055 | A | * | 7/1998 | Crittenden | 52/784.1 |
| 5,829,218 | A | | 11/1998 | Murray et al. | |
| 5,884,444 | A | * | 3/1999 | Harris | 52/311.2 |
| 5,887,402 | A | * | 3/1999 | Ruggie et al. | 52/455 |
| 5,918,434 | A | | 7/1999 | Ballantyne et al. | |
| 6,148,896 | A | * | 11/2000 | Pinto et al. | 160/229.1 |
| 6,185,894 | B1 | | 2/2001 | Sisco et al. | |
| 6,190,782 | B1 | | 2/2001 | French | |
| 6,311,454 | B1 | * | 11/2001 | Kempel | 52/784.15 |
| 6,335,082 | B1 | * | 1/2002 | Martino | 428/142 |
| 6,513,558 | B1 | | 2/2003 | Chen | |
| 6,584,667 | B1 | | 7/2003 | Frumkin | |
| 6,619,010 | B2 | * | 9/2003 | Wang Chen | 52/784.13 |
| 6,684,590 | B2 | * | 2/2004 | Frumkin | 52/456 |
| 6,688,063 | B1 | | 2/2004 | Lee et al. | |
| D501,931 | S | | 2/2005 | Davina et al. | |
| 6,952,903 | B2 | | 10/2005 | West et al. | |
| 7,007,435 | B2 | | 3/2006 | Ballantyne | |
| 7,137,232 | B2 | | 11/2006 | Lynch et al. | |
| 7,178,308 | B2 | | 2/2007 | Fagan et al. | |
| 7,185,468 | B2 | | 3/2007 | Clark et al. | |
| D541,947 | S | | 5/2007 | Schafemak et al. | |
| D543,641 | S | | 5/2007 | Walsh et al. | |
| 7,210,274 | B2 | | 5/2007 | Ballantyne et al. | |
| D553,756 | S | | 10/2007 | Davina et al. | |
| D554,769 | S | | 11/2007 | Hardaway | |
| D555,806 | S | * | 11/2007 | Berryman | D25/48 |
| 7,328,539 | B2 | * | 2/2008 | Hunt et al. | 52/784.15 |
| 7,481,900 | B1 | | 1/2009 | Quinif | |
| D615,212 | S | | 5/2010 | Walsh et al. | |
| 2003/0014932 | A1 | * | 1/2003 | Wang et al. | 52/316 |
| 2003/0115817 | A1 | * | 6/2003 | Blackwell et al. | 52/456 |
| 2004/0172914 | A1 | | 9/2004 | Lancia | |
| 2007/0024085 | A1 | | 2/2007 | Steelman | |
| 2007/0193220 | A1 | | 8/2007 | Daniels | |
| 2208/0256885 | | | 10/2008 | Walsh et al. | |

OTHER PUBLICATIONS

Office Action from the United States Patent and Trademark Office dated Jan. 3, 2011 for U.S. Appl. No. 12/427,518.

* cited by examiner

FIG. 3
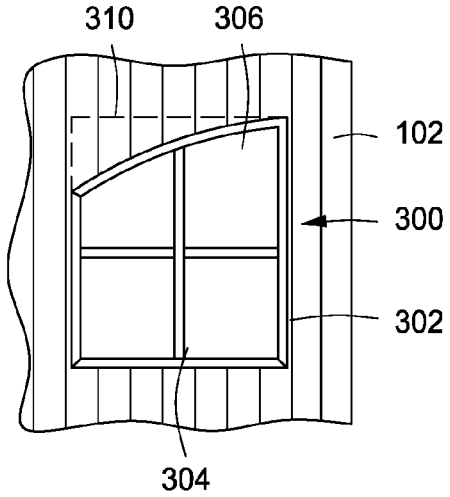
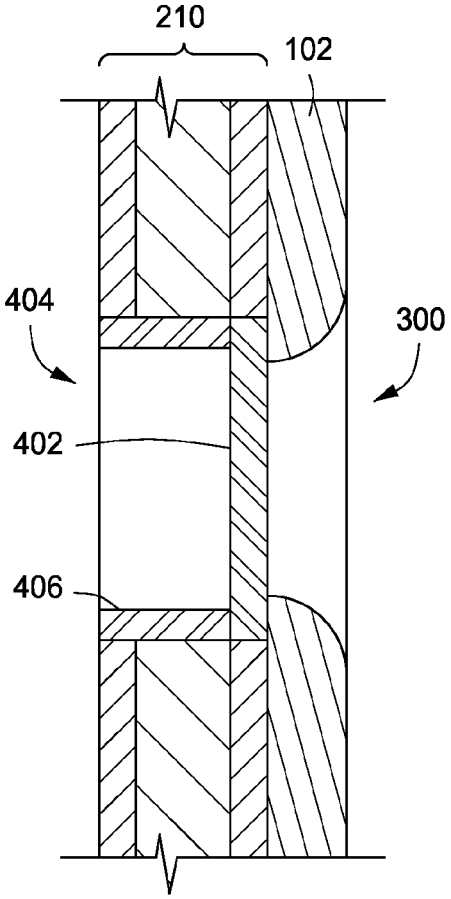
FIG. 4A
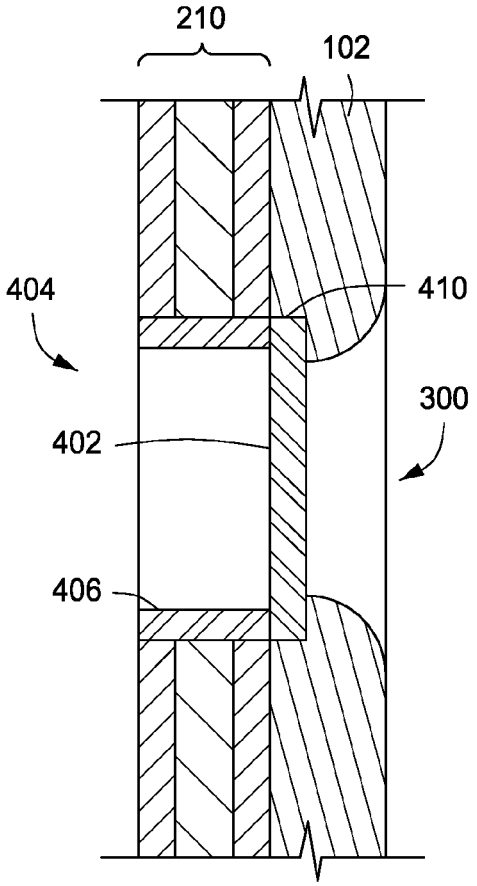
FIG. 4B

CARVED SOLID FACE DOOR AND METHOD OF FABRICATION

CROSS-REFERENCE TO RELATED APPLICATIONS

This application claims benefit of U.S. Provisional Patent Application Ser. No. 60/723,764, filed Oct. 5, 2005, which is herein incorporated by reference.

BACKGROUND OF THE INVENTION

1. Field of the Invention

The present invention generally relates to doors and, more particularly, to doors having a façade formed from a solid piece of material and methods of manufacturing thereof.

2. Description of the Related Art

Doors, and particularly large doors such as overhead garage doors, come in numerous styles, shapes, and sizes. In a residential setting, many people prefer garage doors that are embellished or stylized to enhance the outer appearance of their homes. Such garage doors may be manufactured using a stamped metal or vinyl exterior or a more traditional multiple-piece construction (such as rail and stile construction).

However, these manufacturing methods each have their own drawbacks. For example, garage doors having a stamped metal exterior have design limitations due to the nature of the materials and tools required to form the desired patterns on the face of the door. In addition, each design requires varying tools to stamp the designs into the door. As such, this method is very expensive to use for larger numbers of designs.

Multiple-piece construction techniques are usually very time-consuming, due to the number of different parts that must be fabricated, aligned, and assembled to form the door. Moreover, the likelihood of quality control issues arising, such as out of tolerance, overall appearance of the door, or door-to-door variations increases with the number of components to be fabricated and pieced together.

Therefore, a need exists for a door suitable for ease of fabrication and flexibility of design options.

SUMMARY OF THE INVENTION

Embodiments of the present invention provides a door and method of manufacture therefor. In one embodiment, the door includes a substantially solid flat face with a desired design carved into the flat face to emulate the look of a door manufactured using other traditional techniques, such as stamping or multiple-piece construction. Optionally, the door may have a backing affixed to the front face for support. The door may be manufactured using computer-aided machinery to carve the design. The flat face of the door may optionally further comprise multiple sections.

In one embodiment, a carved solid face door includes a solid base having a substantially flat face and an opposing rear surface, wherein the face has a design carved into at least one section of the face that emulates the appearance of a multiple-piece construction including at least one of a frame, a rail, a stile, a molding, a trim, a plurality of planks, or a panel.

In another embodiment, a method of making a door is provided. The method includes making a carving into a front portion of the flat face to form a generally decorative pattern in the door. In one embodiment, the design is carved into the flat face using a computer-controlled machine, such as a computer numerical control (CNC) milling machine, or the like.

In one embodiment, a method for fabricating a door includes providing a solid base having a substantially flat face and an opposing rear surface; and carving a design into the face to emulate the appearance of a multiple-piece construction including at least one of a frame, a rail, a stile, a molding, a trim, a plurality of planks, or a panel.

BRIEF DESCRIPTION OF THE DRAWINGS

So the manner in which the above recited features of the present invention can be understood in detail, a more particular description of the invention, briefly summarized above, may be had by reference to the embodiments thereof, some of which are illustrated in the appended drawings. It is to be noted, however, the appended drawings illustrate only typical embodiments of this invention and are therefore not to be considered limiting of its scope, for the invention may admit to other equally effective embodiments.

FIG. 3 is depicts a window that may be formed in the door of FIG. 1.

FIGS. 4A-B depict a partial sectional side view of embodiments of the window of FIG. 3.

To facilitate understanding, identical reference numerals have been used, where possible, to designate identical elements that are common to the figures.

DETAILED DESCRIPTION

Embodiments of the present invention provide a door suitable for ease of construction in a variety of styles/designs and a method of manufacturing the door. The door may be any door, including front entranceways, overhead garage doors, side-mounted garage doors, and the like. The door has a solid flat face with a desired design carved into the flat face. The design may emulate the look of a door manufactured using other traditional techniques, such as stamping or multiple-piece construction (e.g., rail and stiles, raised panels, and the like). Optionally, the door may have a backing affixed to the front face for support. The door may be efficiently manufactured using computer-aided machinery to carve the design.

Figure 1:
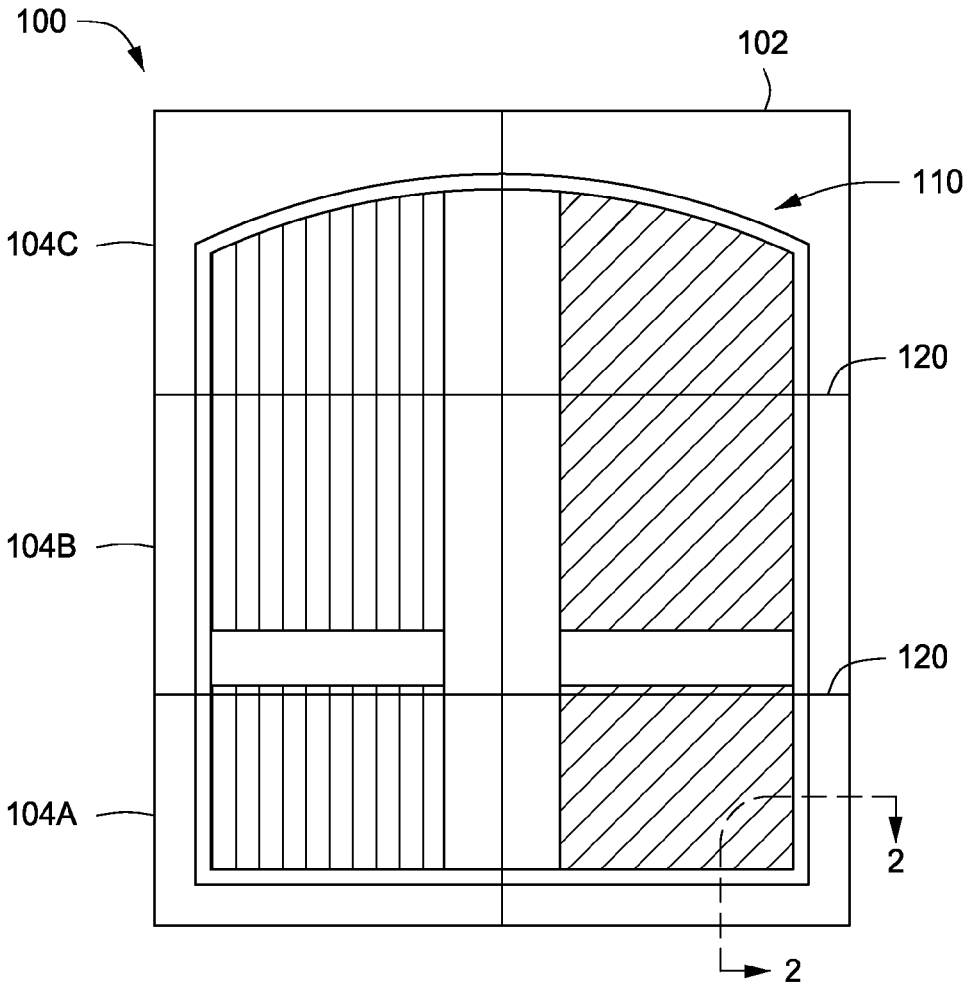
FIG. 1 depicts a front view of one embodiment of a door of the present invention.

FIG. 1 depicts one embodiment of a door 100 of the present invention. The door 100 generally comprises a solid base having a flat face 102 into which a design 110 is carved. The flat face 102 may comprise any suitable workable material, such as wood, medium density fiberboard (MDF), plastic, cellular polyvinyl chloride (PVC), and the like. Alternatively, the flat face 102 may comprise a flat laminate of multiple sheets of one or more of the aforementioned materials.

The flat face 102 of the door 100 may optionally further comprise multiple sections. In the embodiment depicted in FIG. 1, three sections 104A-C are depicted. The sections 104A-C may be formed by cutting the door 100 along lines 120 after forming the design 110 or, the sections 104A-C may be individually fabricated and thereafter assembled to form the final door 100. It is contemplated that the door 100 may comprise any number of sections, including a single section.

The design 110 is carved into a front portion of the flat face 102 to form a generally decorative pattern in the door 100. The design 110 may be carved into the flat face 102 in a variety of ways. In one embodiment, the design 110 is carved into the flat face 102 using a computer-controlled machine, such as a computer numerical control (CNC) milling machine, or the like. Using a computer-aided machine, the design 110 may be formed into the flat face 102 of the door 100 with tight tolerances, repeatability, speed, and excellent process control. Moreover, the design 110 may be expediently and inexpensively changed or altered to varying designs simply by loading a new design into the computer-aided machine. This facilitates greater speed and flexibility of manufacturing as compared to expensive and time consuming traditional methods of manufacturing doors.

By carving the design 110 into the flat face 102 of the door 100, embodiments of the present invention facilitate emulation of the look of a traditional multi-piece construction (such as at least one of a frame, a rail, a stile, a molding, a trim, a plurality of planks, or a panel) with greater design flexibility, process repeatability, and speed of construction. In addition, carving the design 110 into the flat face 102 of the door facilitates greater design flexibility as compared to traditional stamped steel and vinyl construction techniques. Specifically, the carved design 110 may have designs that flow between adjacent sections (e.g., sections 104A-C) of the door 100. In stamped steel doors, the sections typically have uniform raised edges due to the rolled edge at the border of adjacent sections. Moreover, in accordance with embodiments of the present invention, changing from one design to the next in a production environment may be accomplished by merely loading, or selecting a preloaded, new design program in the computer-controlled machine, thereby facilitating simple, quick, and practically seamless changeovers to new products.

Figure 2:
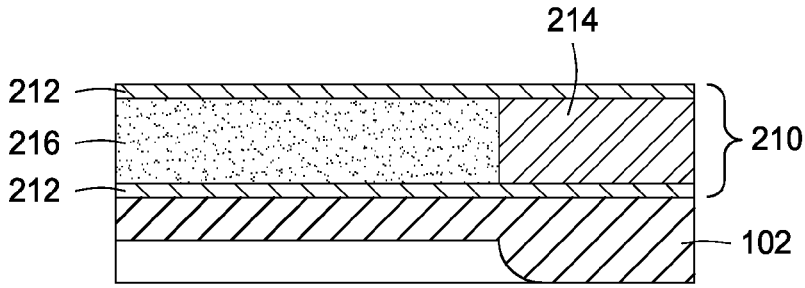
FIG. 2 is a partial sectional view of the door of FIG. 1, taken along section lines 2-2.

In one embodiment, the door 100 may further optionally comprise a backing to stiffen, strengthen, or otherwise structurally support the flat face 102. FIG. 2 depicts one embodiment of a backing 210 affixed to a rear surface of the flat face 102. The backing 210 may be affixed to the flat face 102 in any suitable manner, such as by gluing, bonding, epoxying, screwing, bolting, otherwise adhering or affixing, and the like.

The backing 210 may comprise one or more elements arranged to support the flat face 102 as described above. In one embodiment, the backing 210 comprises an outer frame 214 and an optional inner core 216 that are covered with a skin 212. The frame 214 may comprise wood, plastic, metal, or any other suitable material or combination of materials. The inner core 216 may comprise foam or other suitable material and may provide a high insulative rating, or R-value. The skins 212 may comprise any thin, structurally sound material, such as plywood, wood, plastic, MDF, hardboard, and the like. It is contemplated that the flat face 102 may comprise structural elements such as metal rods and or bars in place of or in addition to the backing 210. In an alternative embodiment, the outer frame 214 may be directly affixed to the flat face 102. In this arrangement, relatively larger openings and/or glass sections, and the like, can be formed in the door 100.

FIG. 3 depicts one embodiment of an optional window 300 that may be formed in the door 100 depicted in FIG. 1. The window 300 is formed in the flat face 102 of the door 100 in similar fashion as the design 110. Specifically, the window 300 is carved into the flat face 102 of the door in a desired location. Structural and/or design elements, such as the frame 302 and mullions 304, may optionally be carved into the flat face 102 of the door 100, leaving openings 306 that pass completely through the flat face 102 of the door 100. In embodiments where a backing is used (as depicted in FIG. 2), a corresponding opening is formed in the backing.

The use of a computer-aided machine greatly reduces the time and effort required to align any openings formed in the backing and in the flat face 102. As can be seen in the window 300 of FIG. 3, the openings 306, and optional frame 302 and/or mullions 304 do not need to be square. As the openings 306 are carved out of a solid piece of material (e.g., the flat face 102), the openings 306 may take practically any shape or design, such as circles, ellipses, waves, amoebic forms, as well as triangles, squares, rectangles, other polygons, or combinations thereof.

The window 300 may be left open, or a piece of material such as glass, plastic, or the like (typically glass) may be provided to cover the openings 306 of the window 300. To facilitate manufacture, the glass for the window 300 may be cut into a convenient polygonal shape, such as a square or rectangle, and may be secured to the backside of the flat face. In embodiments where a backing is used, the backing may have a corresponding opening that facilitates the placement of the glass in the window 300, as indicated by the dashed lines 310 in FIG. 3.

In one embodiment, as depicted in FIG. 4A, a hole 404 is formed in the backing 210 corresponding to the location of the window 300 such that a piece of glass 402 or other desired material may be placed in the opening 404 and rest against the back surface of the flat face 102. An insert 406 may then be placed over the glass 402 to secure it in place and to provide a clean, finished appearance to the hole 404 in the backing 210.

In another embodiment, depicted in FIG. 4B, a rabbet 410 may be machined into the backside of the flat face 102 to accommodate the glass 402 such that it rests flush with the backside of the flat face 102. The insert 406 is then placed within the hole 404 to secure the glass 402 and provide a clean, finished appearance to the hole 404 in the backing 210.

Thus, in one embodiment of the present invention a door has been provided that facilitates flexibility and ease of construction in a variety styles/designs and a method of manufacturing the door. The door has a desired design carved into a solid flat face that may be efficiently manufactured using computer-aided machinery to fabricate the design. The use of computer-aided machinery facilitates raised levels of production as compared to traditional techniques while maintaining or improving quality, accuracy, and repeatability, as well as reducing changeover times and costs to implement new designs.

While the foregoing is directed to the illustrative embodiment of the present invention, other and further embodiments of the invention may be devised without departing from the basic scope thereof, and the scope thereof is determined by the following claims.

I claim:

1. A door, comprising:

a solid base having a substantially flat face and a substantially flat opposing rear surface, wherein the face has a design carved into at least one section of the face that emulates the appearance of a multiple-piece construction including at least one of a frame, a rail, a stile, a molding, a trim, a plurality of planks, or a panel, and wherein the solid base comprises at least one of wood, plastic, or cellular polyvinyl chloride; and a backing having a first side coupled to the rear surface of the flat face and an opposing second side having a skin substantially covering the opposing rear surface of the solid base and not having a pattern carved into the skin, wherein the door comprises a plurality of separate horizontal sections that can be assembled together to form the final door, each separate horizontal section comprising a portion of the backing and the solid base.

2. The door of claim 1, wherein the backing further comprises:

an outer frame.

3. The door of claim 2, wherein the outer frame comprises at least one of wood, plastic, or metal.

4. The door of claim 2, wherein the backing further comprises:

an inner core disposed within the outer frame.

5. The door of claim 1, wherein the skin comprises at least one of plywood, wood, plastic, medium density fiberboard, or hardboard.

6. The door of claim 1, wherein the design flows between the plurality of horizontal sections.

7. The door of claim 1, further comprising:

a window formed in the face.

8. The door of claim 7, further comprising:

at least one of glass or plastic disposed within the window.

9. The door of claim 8, wherein an opening is formed in the rear surface of the base and corresponding to the window in the face for supporting a rectangular piece of glass or plastic.

10. The door of claim 9, wherein the window is non-rectangular.

11. The door of claim 1, further comprising:

at least one structural rod affixed to the rear surface of the base.

12. The door of claim 1, wherein the solid base comprises a substantially uniform thickness except for the at least one section having the design carved therein, wherein the at least one section has a thickness that is less than the substantially uniform thickness.

13. A door, comprising:

a solid base having a substantially flat face and a substantially flat opposing rear surface, wherein the face has a design carved into at least one section of the face that emulates the appearance of a multiple-piece construction including at least one of a frame, a rail, a stile, a molding, a trim, a plurality of planks, or a panel; and a backing coupled to the substantially flat opposing rear surface of the solid base, the backing comprising an outer frame, having a first side facing the solid base and a second side opposing the solid base, and a first skin covering the second side of the outer frame such that the first skin substantially covers the opposing rear surface of the solid base, wherein the first skin does not have a pattern carved therein, wherein the door comprises a plurality of separate horizontal sections that can be assembled together to form the final door, wherein each of the plurality of separate horizontal sections comprises a portion of the backing and the solid base.

14. The door of claim 13, wherein the solid base comprises at least one of wood, plastic, medium density fiberboard, or cellular polyvinyl chloride.

15. The door of claim 13, wherein the backing further comprises:

an inner core disposed within the outer frame.

16. The door of claim 13, wherein the outer frame comprises at least one of wood, plastic, or metal.

17. The door of claim 13, wherein the first skin comprises at least one of plywood, wood, plastic, medium density fiberboard, or hardboard.

18. The door of claim 13, further comprising:

a window formed in the face.

19. The door of claim 13, further comprising:

at least one of glass or plastic disposed within the window.

20. The door of claim 19, wherein an opening is formed in the rear surface of the base and the backing corresponding to the window in the face.

21. The door of claim 13, further comprising:

at least one structural rod affixed to the rear surface of the base.

* * * * *